US010516924B2

(12) United States Patent
Chappell

(10) Patent No.: US 10,516,924 B2
(45) Date of Patent: Dec. 24, 2019

(54) TORSION SPRING CEILING GRILL

(71) Applicant: Mitek Corp., Inc., Phoenix, AZ (US)

(72) Inventor: Kenneth Wade Chappell, Midlothian, TX (US)

( * ) Notice: Subject to any disclaimer, the term of this patent is extended or adjusted under 35 U.S.C. 154(b) by 232 days.

(21) Appl. No.: 15/467,136

(22) Filed: Mar. 23, 2017

(65) Prior Publication Data

US 2018/0279026 A1 Sep. 27, 2018

(51) Int. Cl.
*H04R 1/02* (2006.01)
*F24F 13/08* (2006.01)

(52) U.S. Cl.
CPC ..... *H04R 1/023* (2013.01); *F24F 13/084* (2013.01); *F24F 2221/14* (2013.01)

(58) Field of Classification Search
CPC .. F24F 13/084; F24F 13/0254; F24F 2221/14; H04R 1/023; H04R 1/025; H04R 1/026; H04R 2201/021; F21S 8/026; F21S 8/04
See application file for complete search history.

(56) References Cited

U.S. PATENT DOCUMENTS 2,802,933 A * 8/1957 Broadwin ..... F21V 21/04 248/327
2,914,287 A * 11/1959 Henning ..... E04B 9/32 248/343
2,954,959 A * 10/1960 Lund ..... F21V 17/00 248/343
3,815,857 A * 6/1974 McFarlin ..... F21S 8/02 174/503
3,912,865 A * 10/1975 Seebinger ..... E04B 9/006 248/343
4,399,497 A * 8/1983 Druffel ..... F21S 8/02 362/362
4,673,149 A * 6/1987 Grote ..... E04B 9/006 248/27.1
5,077,650 A * 12/1991 Cestari ..... F21V 21/04 362/147

(Continued)

OTHER PUBLICATIONS

Lowell Spec No. 1642 [Rev. Dec. 16, 2015], Lowell Manufacturing Company, http://www.lowellmfg.com/wp-content/uploads/1642-WB8T.pdf.

*Primary Examiner* — Joshua Kaufman
(74) *Attorney, Agent, or Firm* — Keith L. Jenkins, Registered Patent Attorney, LLC; Keith L. Jenkins

(57) ABSTRACT

A torsion spring ceiling grill that is reconfigurable to adapt smoothly to various thicknesses of ceiling tiles. The ceiling tile has an opening to which a grill plate and a backing plate correspond. The grill plate attaches to the backing plate via the torsion springs, clamping the ceiling tile in between. The torsion spring assemblies can be reconfigured by repositioning an axle of each torsion spring assembly in its respective slot in vertical spring support panels of the grill plate. The torsion spring assemblies can be releasably secured at any position along the slot. The backing plate has spring-receiving openings on a top horizontal panel that extends out over the opening in the ceiling tile to receive arms of the torsion springs. Arms of the torsion springs may be bound by a severable connector which is severed by a blade above the top horizontal panel during installation.

20 Claims, 7 Drawing Sheets

(56) References Cited

U.S. PATENT DOCUMENTS

| | | | | | |
|---|---|---|---|---|---|
| 5,143,339 | A * | 9/1992 | Ashcraft | H04R 1/025 | 248/320 |
| 5,410,782 | A * | 5/1995 | Holyoake | F24F 13/0209 | 24/505 |
| 5,931,432 | A * | 8/1999 | Herold | F21V 21/04 | 248/343 |
| 5,971,847 | A * | 10/1999 | Webb | B60H 1/3435 | 454/290 |
| 6,142,254 | A * | 11/2000 | Claybaugh | H04R 1/023 | 181/141 |
| 7,191,993 | B2 * | 3/2007 | Bobrowski | F21V 21/04 | 248/318 |
| 9,557,022 | B2 * | 1/2017 | Araki | F21S 8/026 | |
| 9,729,952 | B2 * | 8/2017 | Ivey | F16M 13/027 | |
| 9,807,485 | B1 * | 10/2017 | Ivey | H04R 1/026 | |
| 9,970,636 | B1 * | 5/2018 | Winters | F21V 21/30 | |
| 2012/0292458 | A1 * | 11/2012 | Cheng | H04R 1/026 | 248/27.3 |
| 2015/0241037 | A1 * | 8/2015 | Zhang | F21V 13/04 | 362/308 |
| 2017/0115028 | A1 * | 4/2017 | Lee | B01D 46/0005 | |
| 2017/0314770 | A1 * | 11/2017 | Pahl | F21V 21/16 | |
| 2017/0328547 | A1 * | 11/2017 | Shapiro | F21V 21/30 | |
| 2018/0172898 | A1 * | 6/2018 | Blessitt | G02B 6/0088 | |
| 2018/0279026 | A1 * | 9/2018 | Chappell | H04R 1/023 | |

* cited by examiner

TORSION SPRING CEILING GRILL

FIELD OF ART

The present invention relates to manually installable ceiling tile grills for audio speakers, ventilation, or other purposes. The present invention more particularly relates to a ceiling tile grill that is suspended my torsion springs which are reconfigurable as to position on the grill frame to adapt to various thicknesses of ceiling tiles.

BACKGROUND OF THE INVENTION

The use of audio speakers mounted on ceiling tiles of suspended ceilings and directing sound output downward into the room below the ceiling is well known. Typically, a grill is interposed between the diaphragm of the audio speaker and the room, either as part of the audio speaker or as part of the ceiling tile. Making the grill part of the audio speaker means adding the cost of the grill if an audio speaker needs to be replaced. Making the grill integral to the tile makes access to the top of the tile more difficult, with attendant higher labor costs. Making a grill that is releasably attached to the ceiling tile is conventionally constructed such that the grill attachment means is designed for only one thickness of ceiling tile.

Torsion springs are coil springs with the ends of the spring wire extended at wide angles, In operation, the coil spring is attached to a first device and the arms of a coil spring are compressed together and inserted through an opening in a second device, thereafter expanding apart to secure the first device to the second device.

Accordingly, a ceiling tile grill is needed that is independent of the audio speaker. releasably attachable to the ceiling tile, and that is reconfigurable for various thicknesses of ceiling tile.

SUMMARY OF THE INVENTION

Briefly described, the invention includes a releasably attachable grill having torsion spring connectors that connect to a backing plate, and in which the positions of the torsion spring connectors can be manually reconfigured for various thicknesses of ceiling tile. In an embodiment, the arms of the torsion springs are bound together with a severable connector for easy insertion into spring-receiving openings in a backing plate. Small knife edges mounted above the spring-receiving openings in the backing plate sever the severable connector during installation, allowing the spring arms to spring outward to secure the grill to the backing plate.

One embodiment provides a torsion spring ceiling grill including: a grill plate supporting a plurality of torsion spring assemblies, each of which is operable to be reconfigurable in position; and a backing plate adapted to receive first and second arms of the torsion spring assemblies. That torsion spring ceiling grill, where the grill plate includes an operationally horizontal grill plate perimeter flange terminating, at least at a plurality of portions of an interior edge, in an operationally vertical torsion spring support panel operable to support the torsion spring assemblies. That torsion spring ceiling grill, where the torsion spring support panel includes a slot adapted to engage a portion of a torsion spring assembly of the plurality of torsion spring assemblies. That torsion spring ceiling grill, where the slot is vertical. That torsion spring ceiling grill, where each torsion spring assembly of the plurality of torsion spring assemblies includes: an actuator having radial dimensions larger than a width of the slot; an axle, having a diameter less than the width of the slot, extending from the actuator; a coil spring portion of a torsion spring engaged slidingly over the axle; the first and second arms extending from opposing ends of the coil spring; and a spring retainer releasably coupled to the axle. That torsion spring ceiling grill, where the backing plate includes an operationally horizontal backing plate perimeter flange terminating, at least at a plurality of portions of an interior edge of the backing plate perimeter flange, in a operationally vertical panel which, in turn, terminates in a inwardly extending top horizontal panel. That torsion spring ceiling grill, including a spring-receiving opening in the top horizontal panel. That torsion spring ceiling grill, including: a severable connector connecting the first and second arms in a sufficiently proximate configuration to enable insertion into the spring-receiving opening; and a knife blade mounted above the top horizontal panel, centered on the spring-receiving opening, and adapted to sever the severable connector when the first and second arms are inserted into the spring-receiving opening. That torsion spring ceiling grill, including a ceiling tile having a ceiling tile opening, where the backing plate perimeter flange has an interior perimeter coextensive with a perimeter of the ceiling tile opening. That torsion spring ceiling grill, where the top horizontal panel extends over the ceiling tile opening when the backing plate is installed on a top surface of the ceiling tile. That torsion spring ceiling grill, where the axle extends though the slot from an interior side of the vertical spring support panel and receives a nut or a spacer, a coil of the torsion spring, and a spring retainer, in that order.

One embodiment provides a torsion spring ceiling grill including: a grill plate supporting a plurality of torsion spring assemblies, each of which is operable to be reconfigurable as to position; a backing plate adapted to receive first and second arms of the torsion spring assemblies; and where the grill plate includes an operationally horizontal grill plate perimeter flange terminating, at least at a plurality of portions of an interior edge of the grill plate perimeter flange, in an operationally vertical torsion spring support panel operable to support the torsion spring assemblies. That torsion spring ceiling grill, where the torsion spring support panel includes a vertical slot adapted to engage a portion of a torsion spring assembly of the plurality of torsion spring assemblies. That torsion spring ceiling grill, where the backing plate includes an operationally horizontal backing plate perimeter flange terminating, at least at a plurality of portions of an interior edge of the backing plate perimeter flange, in a operationally vertical panel which, in turn, terminates in a inwardly extending top horizontal panel. That torsion spring ceiling grill, including a spring-receiving opening in the top horizontal panel. That torsion spring ceiling grill, including: a severable connector connecting the first and second arms in a sufficiently proximate configuration to enable insertion into the spring-receiving opening; and a knife blade mounted above the top horizontal panel, centered on the spring-receiving opening, and adapted to sever the severable connector when the first and second arms are inserted into the spring-receiving opening.

One embodiment provides a torsion spring ceiling grill including: a grill plate supporting a plurality of torsion spring assemblies, each of which is operable to be reconfigurable as to position; where the grill plate includes an operationally horizontal grill plate perimeter flange terminating, at least at a plurality of portions of an interior edge of the grill plate perimeter flange, in an operationally vertical torsion spring support panel operable to support the torsion spring assemblies; and where the torsion spring support panel includes a vertical slot adapted to engage a portion of a torsion spring assembly of the plurality of torsion spring assemblies; a backing plate adapted to receive first and second arms of the torsion spring assemblies; where the backing plate includes an operationally horizontal backing plate perimeter flange terminating at least at a plurality of portions of an interior edge of the backing plate perimeter flange, in a operationally vertical panel which, in turn, terminates in a inwardly extending top horizontal panel. That torsion spring ceiling grill, where the ceiling tile includes a ceiling tile opening, where the backing plate is attached to a top surface of the ceiling tile and aligned to the ceiling tile opening, where the backing plate perimeter flange has an interior perimeter coextensive with a perimeter of the ceiling tile opening. That torsion spring ceiling grill, further including the grill plate aligned to the ceiling tile opening such that first and second arms of each torsion spring assembly extend through respective spring-receiving openings in the inwardly extending top horizontal panel of the backing plate. That torsion spring ceiling grill, including: a severable connector connecting the first and second arms in a sufficiently proximate configuration to enable insertion into the spring-receiving opening; and a knife blade mounted above the top horizontal panel, centered on the spring-receiving opening, and adapted to sever the severable connector when the first and second arms are inserted into the spring-receiving opening.

DESCRIPTION OF THE FIGURES OF THE DRAWINGS

The present invention will hereinafter be described in conjunction with the following drawing figures, wherein like numerals denote like elements.

DETAILED DESCRIPTION OF THE INVENTION

The words "horizontal", "vertical", "top", and "bottom", as used and defined herein, refer to orientations of the parts of the present invention in an installed orientation. The words "inward" and "outward", as used and defined herein, are referenced to a perimeter of the ceiling tile with the present invention installed therein.

Figure 1:
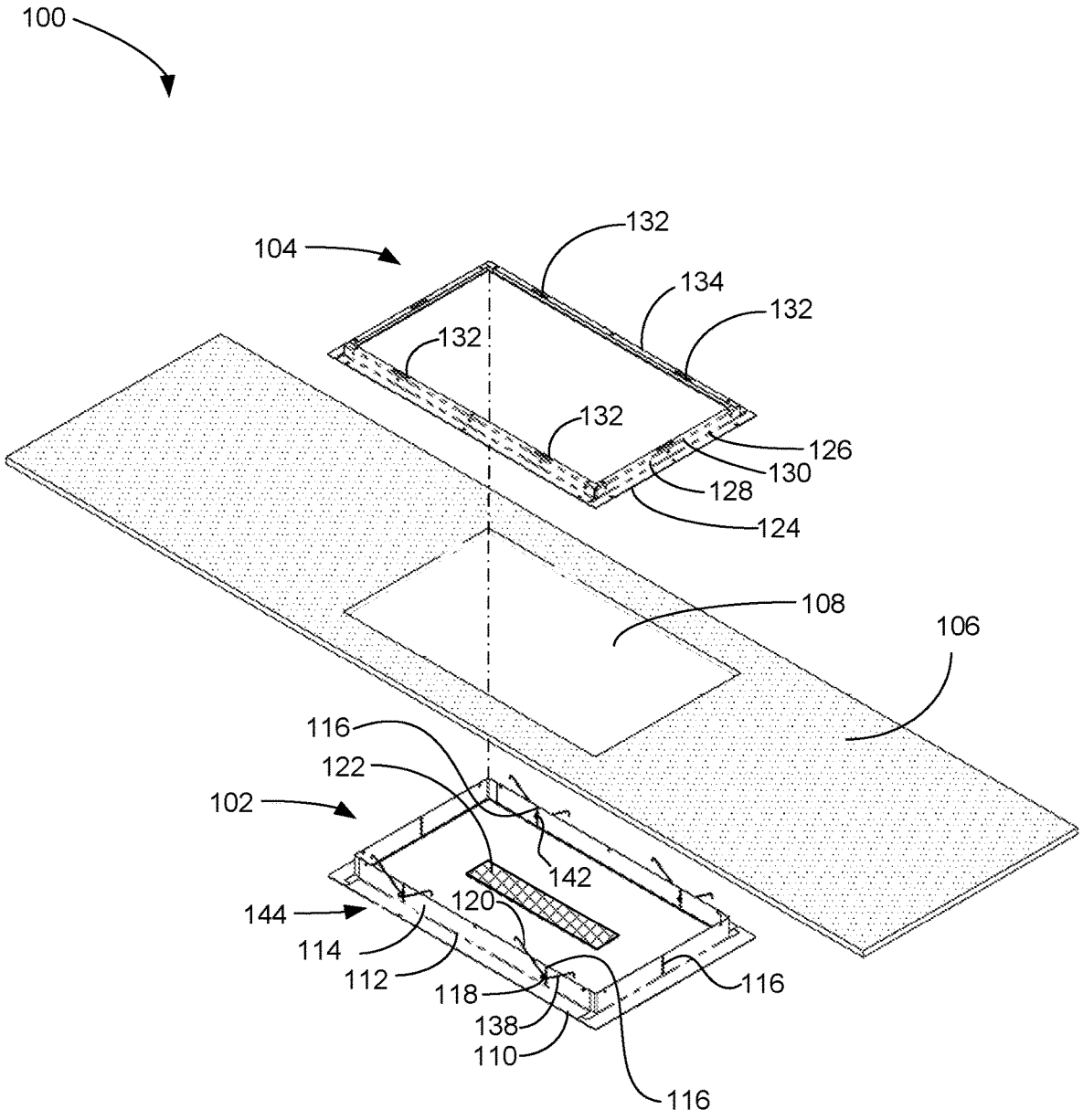
FIG. 1 is an exploded perspective view illustrating an exemplary embodiment of the torsion spring ceiling grill, according to a preferred embodiment of the present invention.

FIG. 1 is an exploded perspective view illustrating an exemplary embodiment of the torsion spring ceiling grill 100, according to a preferred embodiment of the present invention. Ceiling tile 106 has an opening 108, supports backing plate 104, and receives grill plate 102. Ceiling tile 106 may be made of any suitable material and may have any one of the various thickness in which commercially available ceiling tiles 106 are produced. Opening 108 may be precut at a factory or may be cut at a work site. The present invention is not limited to any particular size or shape of ceiling tile 106 or to any particular size or shape of opening 108.

Backing plate 104 has a perimeter flange 124 which surrounds opening 108 and is supported by ceiling tile 106. Perimeter flange 124 is delineated on its inner edge by an angled corner 126 into vertical panel 128, which ends in an angled corner 130 to form top horizontal panel 134. Angled corners 126 and 130 are preferably right-angled corners 126 and 130, but the present invention is not so limited. Top horizontal panel 134 extends over all sides of opening 108. Spring-receiving openings 132 in top horizontal panel 134 each receive torsion spring assembly 144 (one of four labeled) arms 120 and 138 (one pair of four pairs labeled) to support grill plate 102. Backing plate 104 may be made of sheet metal, hard plastic, composite, or other similarly functional material. The size and shape of opening 108 is adapted to the size and shape of backing plate 104 within the limits imposed by ceiling tile 106.

Grill plate 102 has a horizontal (in operation) perimeter flange 110 that is delineated on its inner edge by an angled corner 112 into vertical (in operation) spring support panel 114 (one of four labeled). Angled corner 112 is preferably a right-angled corner 112, but the present invention is not so limited. A vertical spring support panel 114 extends from each interior edge of perimeter flange 110. Vertical spring support panel 114 has at least one vertical slot 116 (two of six labeled) through which a portion of each torsion spring assembly 144 (one of four labeled) extends to provide releasably securable vertical position reconfiguration, adaptable to various thicknesses of ceiling tile 106. Slots 116 on the narrow ends of grill plate 102 are shown without torsion spring assemblies installed. While illustrated as of uniform height, the height of vertical spring support panel 114 may not, in some embodiments, be uniform, nor its extent entire about the perimeter of grill 122. Each torsion spring assembly 144 includes a manually operable securing actuator 142 (one of four labeled) which may be tightened, relative to nut 406 (see FIG. 4) to secure the torsion spring assembly 144 at a particular vertical position in slot 116 or may be released to enable changing the vertical position of torsion spring assembly 144. Actuator 142 is radially extended to be wider than slot 116 in any rotational position. Spring retainer 118 retains the torsion spring 402 on an axle 802 (see FIG. 8) between nut 406 and spring retainer 118. In a particular embodiment, slot 116 may not be exactly vertical. Grill plate 102 has a foraminous grill 122 that extends to all inner sides of the vertical spring support panels 114 but which is illustrated in this view as a patch to enable visualization of the torsion spring assemblies 144. Grill plate 102 may be made of sheet metal, hard plastic, composite, or other similarly functional material. The size and shape of grill plate 102 is adapted to the size and shape of backing plate 104, within the limits imposed by ceiling tile 106 and opening 108.

Figure 2:
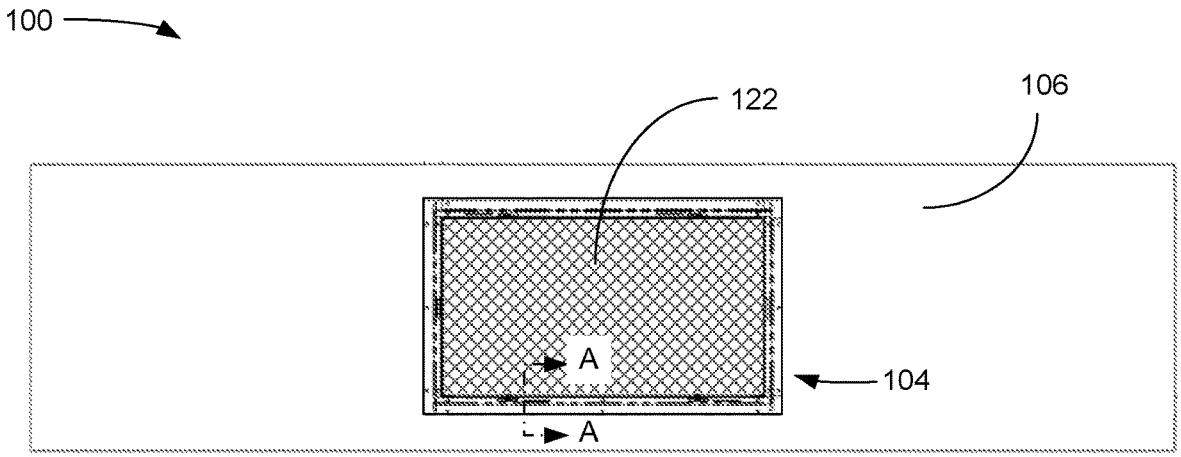
FIG. 2 is a top plan view illustrating the exemplary embodiment of the torsion spring ceiling grill of FIG. 1 and defining cross section AA, according to a preferred embodiment of the present invention.

FIG. 2 is a top plan view illustrating the exemplary embodiment of the torsion spring ceiling grill 100 of FIG. 1 and defining cross section AA, according to a preferred embodiment of the present invention. Foraminous grill 122 is shown to its complete extent in this view. The arrangement of perforations in the foraminous grill 122 may be of any size and arranged in any pattern, within the constraint of being foraminous and not having just one hole.

Figure 3:
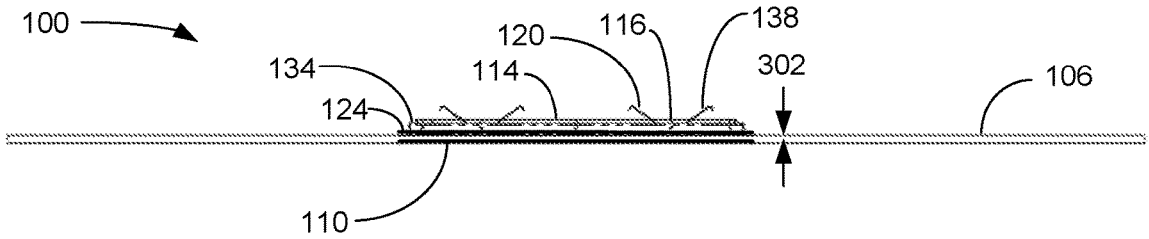
FIG. 3 is a side elevation view illustrating the exemplary embodiment of the torsion spring ceiling grill of FIG. 1, according to a preferred embodiment of the present invention.

FIG. 3 is a side elevation view illustrating the exemplary embodiment of the torsion spring ceiling grill 100 of FIG. 1, according to a preferred embodiment of the present invention. Torsion spring ceiling grill 100 is shown in an installed configuration. Note that, for a ceiling tile 106 having a thickness 302, vertical spring support panel 114 of grill plate 102 extends above Top horizontal panel 134 of the backing plate 104 and that a small portion of slot 116 is visible. The arms 120 and 138 of the torsion spring assemblies 144 are extended through openings 132 and exerting sufficient force to support grill plate 102.

Figure 4:
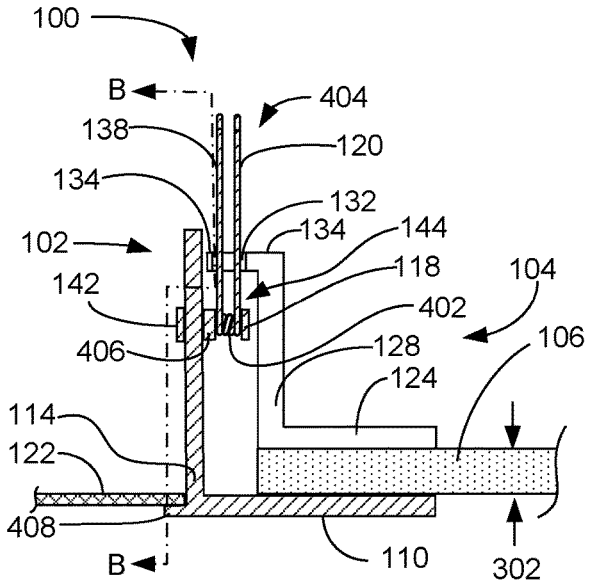
FIG. 4 is a cross sectional view through cross section AA illustrating a detail of the exemplary embodiment of the torsion spring ceiling grill of FIG. 1 and defining cross section BB, according to a preferred embodiment of the present invention.

FIG. 4 is a cross sectional view through cross section AA illustrating a detail of the exemplary embodiment of the torsion spring ceiling grill 100 of FIG. 1 and defining cross section BB, according to a preferred embodiment of the present invention. Ceiling tile 106 is clamped between backing plate perimeter flange 124 and grill plate perimeter flange 110 by the torsion spring assembly 144. For installation, backing plate 104 may be adhered to ceiling tile 106 before ceiling tile 106 is installed in a ceiling, to ensure correct alignment is maintained during installation of the ceiling tile 106. In a particular embodiment, backing plate 104 may be adhered to ceiling tile 106 at a factory and shipped to a worksite with or without grill plate 102 installed. An inward extension 408 of grill plate perimeter flange 110 supports grill 122, and grill 122 is preferably fixed to inward extension 408. The illustrated horizontal and vertical extents of the inward extension 408 are merely exemplary and are not a limitation of the present invention.

Vertical spring support panel 114 supports, within each slot 116, a torsion spring assembly 144. Each torsion spring assembly 144 includes an axle 802 (see FIG. 8) that is threaded along at least a portion of its length and is installed extending through the slot 116. Axle 802 may be a bolt. A securing nut 406 can be tightened to clamp vertical spring support panel 114 between a radially extended actuator 142, such as a bolt head 142, of axle 802. In various embodiments, various shapes and configurations of radially extending actuator 142 may be used, such as, without limitation, a wing nut shape. Torsion spring 404 includes coil spring 402 and arms 120 and 138, which are extensions of coil spring 402. Spring retainer 118 retains torsion spring 404 on axle 802. Arms 120 and 138 extend through a spring-receiving opening 132 in Top horizontal panel 134 of backing plate 104.

Figure 5:
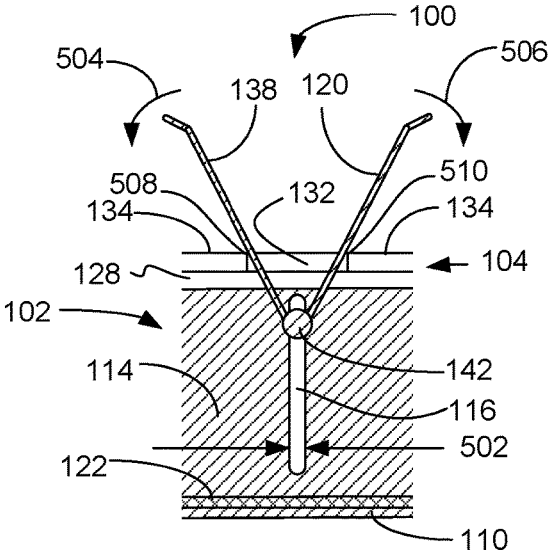
FIG. 5 is a cross sectional view through cross section BB illustrating a detail of the exemplary embodiment of the torsion spring ceiling grill of FIG. 1, according to a preferred embodiment of the present invention.

FIG. 5 is a cross sectional view through cross section BB illustrating a detail of the exemplary embodiment of the torsion spring ceiling grill 100 of FIG. 1, according to a preferred embodiment of the present invention. Slot 116 has a width 502, which is shown as uniform, but uniform width is not a limitation of the present invention. Torsion force 504 is transmitted from coil spring 402 through arm 138 to force arm 138 into abutment with an end edge 508 of spring-receiving opening 132. Torsion force 506 is transmitted from coil spring 402 through arm 120 to force arm 120 into abutment with an opposing end edge 510 of spring-receiving opening 132. These forces 504 and 506 maintain grill panel 102 in a supported position relative to backing panel 104 and ceiling tile 106. Torsion spring assembly 144 may be positioned anywhere within slot 116 to compensate for the thickness 302 of ceiling tile 106, as will be described further below. To achieve sufficient force to support grill plate 102, the points of contact 508 and 510 must occur fairly low on arms 138 and 120, respectively. If ceiling tile 106 is thinner than that illustrated in FIG. 4 and no reconfiguration is made, the points of contact 508 and 510, will occur farther up on arms 138 and 120, respectively, and the force exerted will not be sufficient to support grill plate 102. The present invention has the advantage of being reconfigurable for various ceiling tile thicknesses, such that the supporting forces are sufficient to support grill plate 102 for ceiling tiles 106 of various thicknesses. See FIG. 10 and FIG. 11 for comparisons with FIG. 4.

Figure 6:
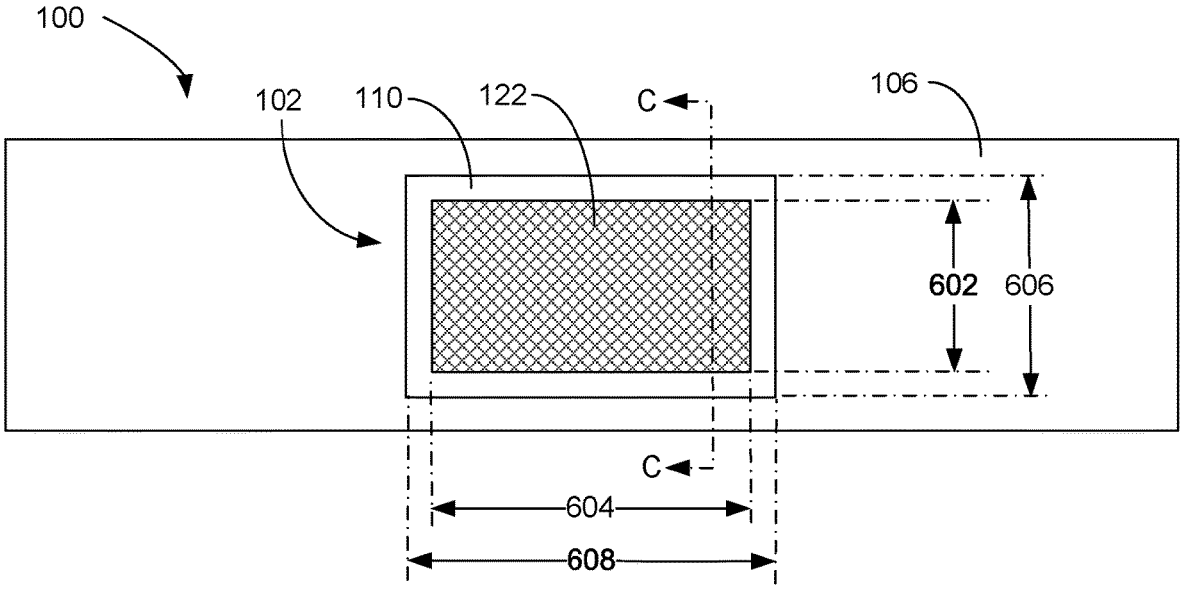
FIG. 6 is a bottom plan view illustrating the exemplary embodiment of the torsion spring ceiling grill of FIG. 1 and defining cross section CC, according to a preferred embodiment of the present invention.

FIG. 6 is a bottom plan view illustrating the exemplary embodiment of the torsion spring ceiling grill 100 of FIG. 1 and defining cross section CC, according to a preferred embodiment of the present invention. Grill plate perimeter flange 110 supplies clamping area for clamping ceiling tile 106 between grill plate perimeter flange 110 and backing plate perimeter flange 124. Sizing of the opening 108 in ceiling tile 106 should leave enough strength in the ceiling tile 106 to support the backing plate 104, the grill plate 102, and any other equipment supported on the ceiling tile 106, such as an audio speaker. In a particular embodiment, an audio speaker may be suspended above the ceiling tile 106, such that the audio speaker does not load the ceiling tile 106. In a particular embodiment for a ceiling tile that is nominally two feet by eight feet, the grill plate perimeter flange 110 has a length 608 of thirty inches and a width 606 of eighteen inches. The grill 122 has a length 604 of twenty-six inches and a width 602 of fourteen inches. Various other embodiments may use various other shapes and dimensions for the ceiling tile 106, grill plate perimeter flange 110, and grill 122, within the constraint of maintaining enough strength in the ceiling tile 106 to support any loads.

Figure 7:
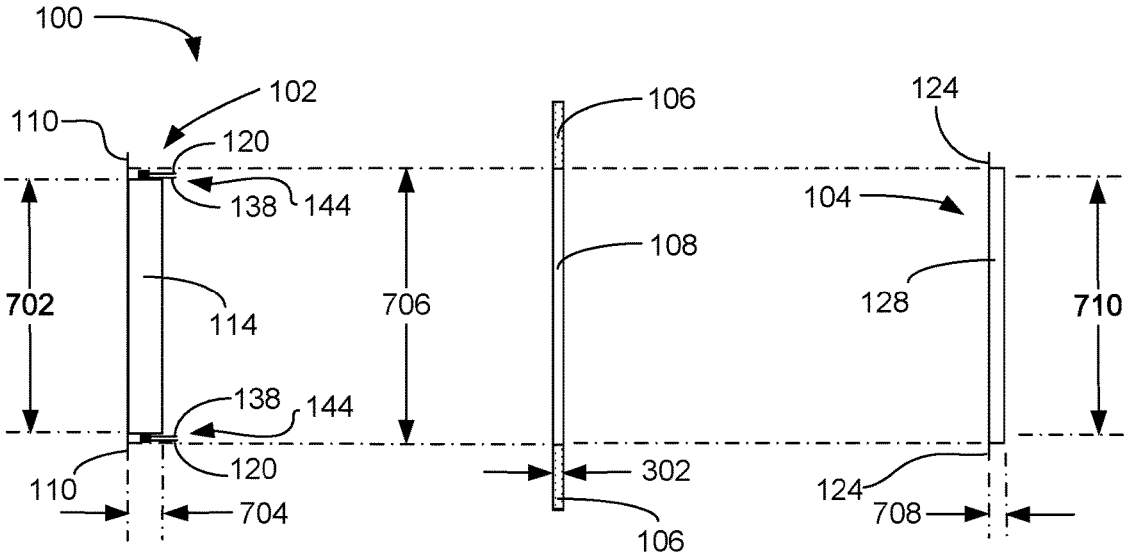
FIG. 7 is an exploded cross sectional view through cross section CC illustrating a detail of the exemplary embodiment of the torsion spring ceiling grill of FIG. 1, according to a preferred embodiment of the present invention.

FIG. 7 is an exploded cross sectional view through cross section CC illustrating a detail of the exemplary embodiment of the torsion spring ceiling grill 100 of FIG. 1, according to a preferred embodiment of the present invention. The ceiling tile opening width 706 is sufficient to allow clearance for the width 702 of the vertical spring support panel 114 plus an allowance for the torsion spring assemblies 144. The height 704 of the vertical spring support panel 114 is shown as greater than the combined ceiling panel thickness 302 and the backing plate height 708. While torsion spring assemblies 144 are shown along the long sides of the grill plate 102, the invention is not so limited. Various embodiments may have torsion spring assemblies 144 on the opposing ends of the grill plate 102. Various embodiments may have various respective numbers of torsion spring assemblies 144.

Figure 8:
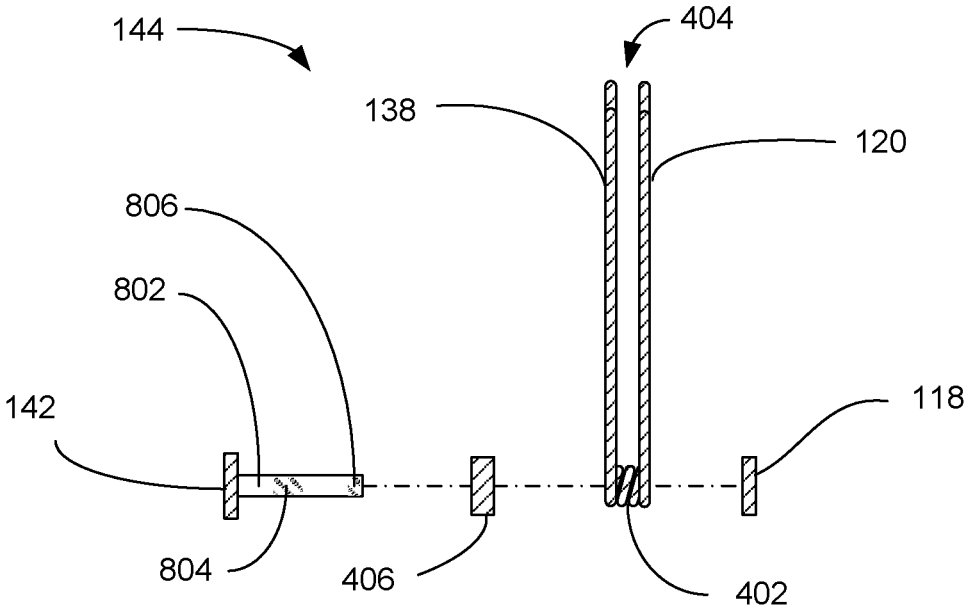
FIG. 8 is an exploded view illustrating an exemplary torsion spring assembly of the exemplary embodiment of the torsion spring ceiling grill of FIG. 1, according to a preferred embodiment of the present invention.

FIG. 8 is an exploded view illustrating an exemplary torsion spring assembly 144 of the exemplary embodiment of the torsion spring ceiling grill 100 of FIG. 1, according to a preferred embodiment of the present invention. Actuator 142 is fixed to axle 802 which may have threaded portions 804 and 806 where needed for nut 406 and spring retainer 118, respectively. Axle 802 has a diameter smaller than the width 502 of slot 116. In various embodiments, more of axle 802 may be threaded. Nut 406 is threaded onto threaded portion 804 and can be held in place while actuator 142 is turned to clamp the torsion spring assembly 144 on the vertical spring support panel 114. Coli spring 402 of torsion spring 404 is slidingly engaged over axle 802 and prevented from sliding off axle 802 by spring retainer 118, which is threaded onto threaded portion 806. In some embodiments, lock washers may be added.

Figure 9:
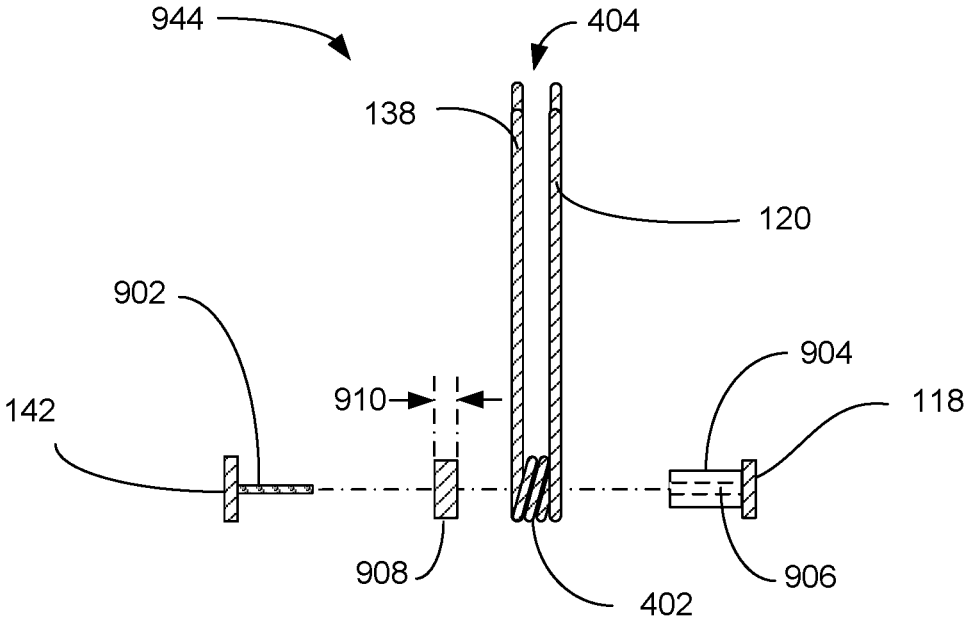
FIG. 9 is an exploded view illustrating a second exemplary torsion spring assembly of the exemplary embodiment of the torsion spring ceiling grill of FIG. 1, according to a preferred embodiment of the present invention.

FIG. 9 is an exploded view illustrating a second exemplary torsion spring assembly 944 of the exemplary embodiment of the torsion spring ceiling grill 100 of FIG. 1, according to a preferred embodiment of the present invention. Barrel 904 extends from, and is of one piece with, spring retainer 118, making the entire piece a spring retainer 118. Barrel 904 has a threaded bore adapted to threadingly receive bolt shaft 902, which extends from actuator 142. Coil spring 402 of torsion spring 404 is slidingly engaged over barrel 904. Spacer 908 is slidingly engaged over barrel 904 and has a width 910 that is predetermined to correctly position torsion spring 404 beneath spring-receiving opening 132. In some embodiments, a lock washer may be added to torsion spring assembly 944.

Figure 10:
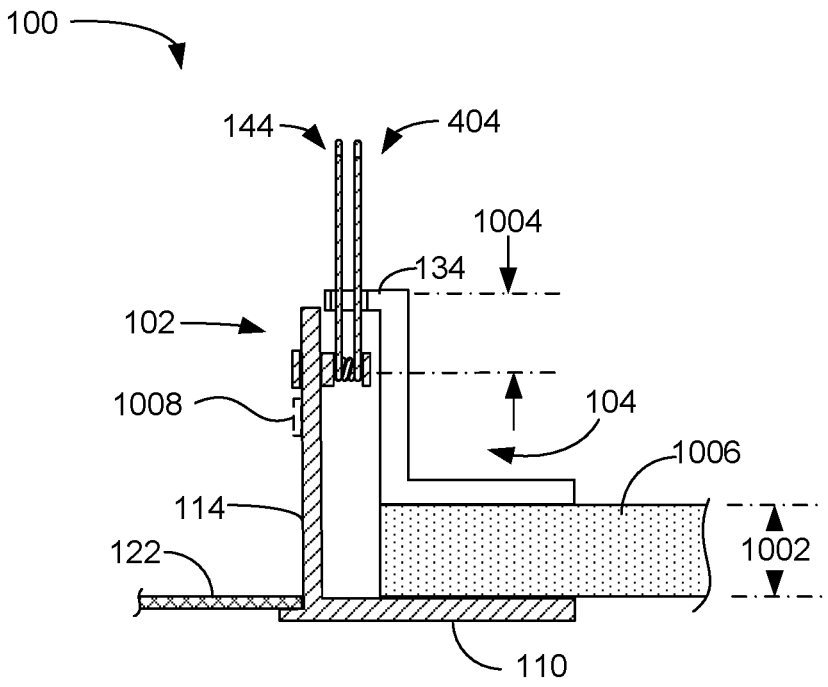
FIG. 10 is a cross sectional view through cross section AA illustrating a detail of the exemplary embodiment of the torsion spring ceiling grill of FIG. 1 in a second configuration, according to a preferred embodiment of the present invention.

FIG. 10 is a cross sectional view through cross section AA illustrating a detail of the exemplary embodiment of the torsion spring ceiling grill 100 of FIG. 1 in a second configuration, according to a preferred embodiment of the present invention. The thickness 1002 of ceiling tile 1006 is greater than the thickness 302 of ceiling tile 106. The torsion spring assembly 144 has been reconfigured upward to maintain the distance 1004 between the centerline of axle 802 and the top of Top horizontal panel 134 to be the same as in FIG. 4. Necessarily, the points 508 and 510 at which arms 138 and 120 contact the edges of spring-receiving openings 132 remain the same, so the force exerted to support the grill plate 102 remains the same. Phantom 1008 shows the location of actuator 142 in FIG. 4, for comparison. If the torsion spring assembly 144 was at the same position as in FIG. 4 with ceiling tile 1006, the points of contact 508 and 510 would be higher up on the arms 138 and 120, respectively, and less, possibly insufficient, force would be applied.

Figure 11:
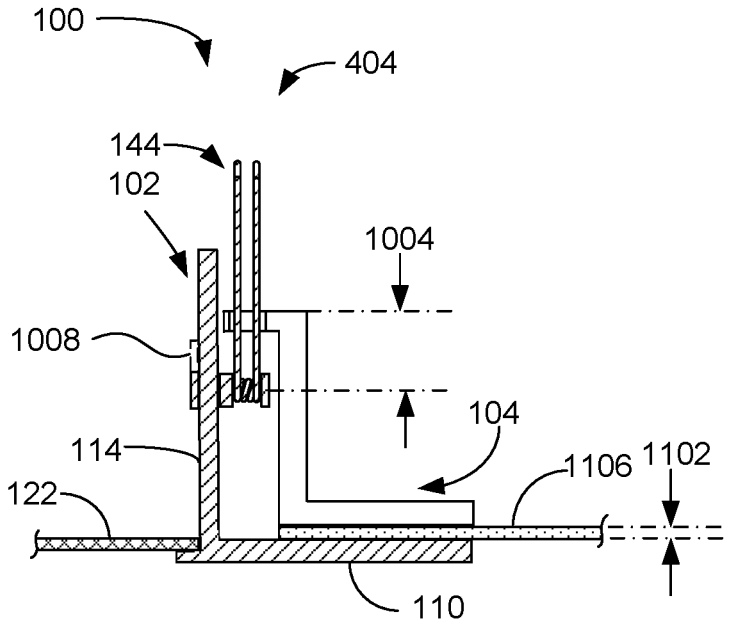
FIG. 11 is a cross sectional view through cross section AA illustrating a detail of the exemplary embodiment of the torsion spring ceiling grill of FIG. 1 in a third configuration, according to a preferred embodiment of the present invention.

FIG. 11 is a cross sectional view through cross section AA illustrating a detail of the exemplary embodiment of the torsion spring ceiling grill 100 of FIG. 1 in a third configuration, according to a preferred embodiment of the present invention. The thickness 1102 of ceiling tile 1106 is less than the thickness 302 of ceiling tile 106. The torsion spring assembly 144 has been reconfigured downward to maintain the distance 1004 between the centerline of axle 802 and the top of Top horizontal panel 134 to be the same as in FIG. 4. Necessarily, the points 508 and 510 at which arms 138 and 120 contact the edges of spring-receiving openings 132 remain the same, so the force exerted to support the grill plate 102 remains the same. Phantom 1008 shows the location of actuator 142 in FIG. 4, for comparison. If the torsion spring assembly 144 was at the same position as in FIG. 4 with ceiling tile 106, the arms 138 and 120 may not contact the end edges 508 and 510, respectively, of spring receiving openings 132, and no force would be applied to support grill plate 102. If the arms 138 and 102 did make contact with the end edges 508 and 510, respectively, of spring receiving openings 132, then the force applied would be greater than desired, making removal of grill plate 102 for maintenance difficult.

While two exemplary embodiments of the torsion spring assembly 144 and 944 have been illustrated, the present invention is not so limited. The advantage of the present invention is in the ability to reconfigure the vertical position of the torsion spring assembly 144 or 944, adapted to different ceiling tile thicknesses. Those of ordinary skill in the art, enlightened by the present disclosure, will be aware of a wide variety of mechanisms for reconfiguration that may be suitable for use in the grill plate 102. For some examples, and without limitation, cams, screw jacks, and rack and pinion devices may be used in various embodiments. Likewise, in various embodiments, torsion springs of various designs and strengths may serve. While the present invention is primarily for audio speaker grills, other uses are possible: for non-limiting example, as an air vent grill.

Figure 12:
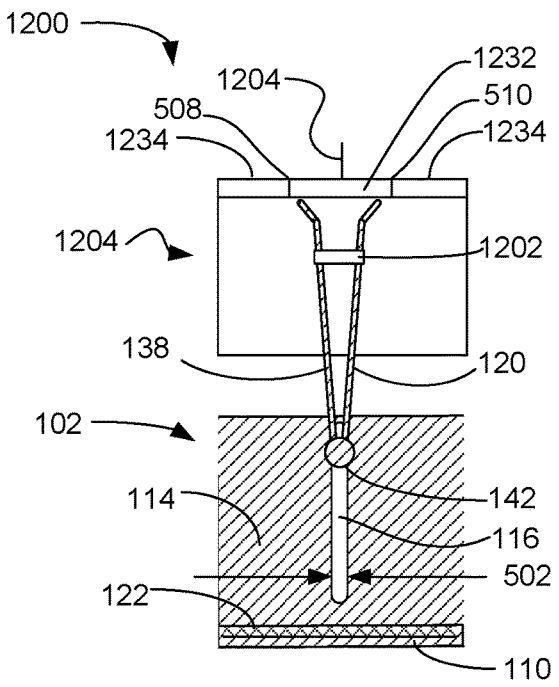
FIG. 12 is a cross sectional view through a cross section similar to cross section BB illustrating a detail of a second exemplary embodiment of the torsion spring ceiling grill in a first position, according to a preferred embodiment of the present invention.

FIG. 12 is a cross sectional view through a cross section similar to cross section BB illustrating a detail of a second exemplary embodiment of the torsion spring ceiling grill 1200 in a first position, according to a preferred embodiment of the present invention. In the second embodiment, torsion spring arms 138 and 120 are bound together by a severable connector 1202, such as a paper band 1202, as shown. Those of skill in the art, enlightened by the present disclosure, will understand that a wide variety of materials may be used for the severable connector 1202, all of which are within the scope of the present invention. Arms 138 and 120 are bound closely enough together to fit into spring-receiving opening 1232 (similar to spring-receiving opening 132) and at a point proximate the distal ends of the arms, to reduce the required tensile strength of the severable connector 1202. Top horizontal panel 1234 (similar to top horizontal panel 134) of back plate 1204 (similar to back plate 104) has a knife blade 1204 centered on spring-receiving opening 1232. For shipment, arms 138 and 120, along with severable connector 1202, may be rotated ninety degrees to lie along spring support panel 114. Just prior to installation, arms 138 and 120, as well as severable connector 1202 are rotated back to the vertical position, as shown. In a particular embodiment, détentes may be used to make both the stowed and deployed positions stable. With a grill plate 102 having a plurality of torsion spring arms 138 and 120 for a respective plurality of spring-receiving openings 1232, having a severable connector 1202 for each pair of arms 138 and 120 advantageously enables the grill plate 102 to be aligned to the spring-receiving openings 1232 and pushed up into an installed position with a single motion, rather than individually compressing the arms 138 and 120 and aligning each in turn.

Figure 13:
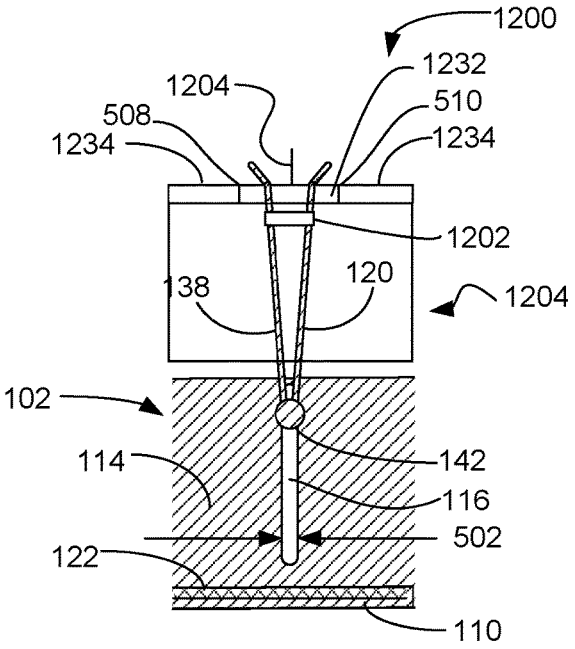
FIG. 13 is a cross sectional view through a cross section similar to cross section BB illustrating a detail of the second exemplary embodiment of the torsion spring ceiling grill of FIG. 12 in a second position, according to a preferred embodiment of the present invention.

FIG. 13 is a cross sectional view through a cross section similar to cross section BB illustrating a detail of the second exemplary embodiment of the torsion spring ceiling grill 1200 of FIG. 12 in a second position, according to a preferred embodiment of the present invention. Arms 138 and 120 are inserted into spring receiving opening 1232, but severable connector 1202 is not yet engaged by knife blade 1204. Note that, the distance between knife blade 1204 and edge 508 and edge 510 is too small to allow arms 138 and 120 to enter. As a result, any small error in alignment during installation will be cured by the bent tip of one of the arms 138 and 120 sliding on the knife blade 1204 to better align the arms 138 and 120 for installation.

Figure 14:
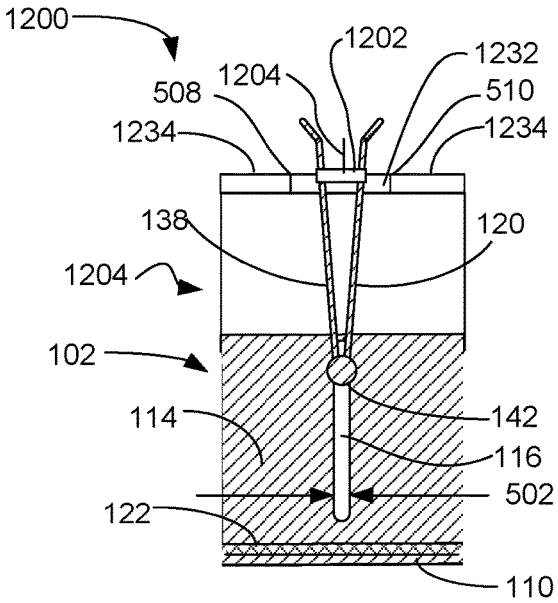
FIG. 14 is a cross sectional view through a cross section similar to cross section BB illustrating a detail of the second exemplary embodiment of the torsion spring ceiling grill of FIG. 12 in a third position, according to a preferred embodiment of the present invention.

FIG. 14 is a cross sectional view through a cross section similar to cross section BB illustrating a detail of the second exemplary embodiment of the torsion spring ceiling grill 1200 of FIG. 12 in a third position, according to a preferred embodiment of the present invention. As grill plate 102 is raised toward spring receiving opening 1232, knife blade 1204 begins to sever the severable connector 1202 when the arms 138 and 120 are well within the spring-receiving opening 1232.

Figure 15:
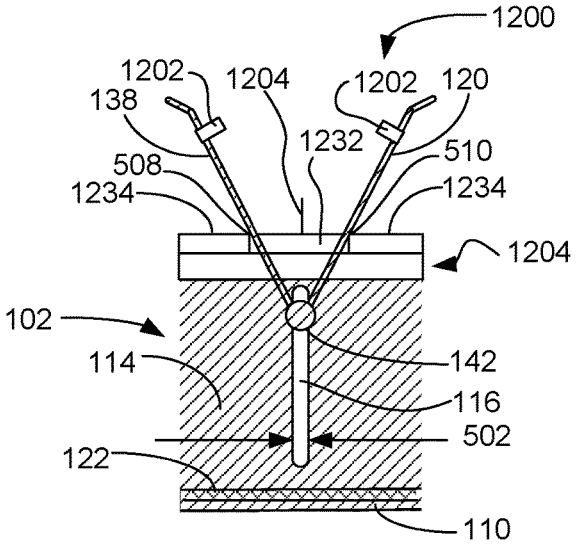
FIG. 15 is a cross sectional view through a cross section similar to cross section BB illustrating a detail of the second exemplary embodiment of the torsion spring ceiling grill of FIG. 12 in a fourth position, according to a preferred embodiment of the present invention.

FIG. 15 is a cross sectional view through a cross section similar to cross section BB illustrating a detail of the second exemplary embodiment of the torsion spring ceiling grill 1200 of FIG. 12 in a fourth position, according to a preferred embodiment of the present invention. Knife blade 1204 has severed the severable connector 1202 and the arms 138 and 120 have spread apart within the spring-receiving opening 1232, coupling the grill plate 102 to the top horizontal panel 1234 to the back plate 1204. Portions of severable connector 1202 are shown attached to each arm 138 and 120. In another embodiment, the severed severable connector 1202 adheres to only one of the arms 138 and 120. In yet another embodiment, severed severable connector 1202 does not adhere to either arm 138 or 120.

Figure 16:
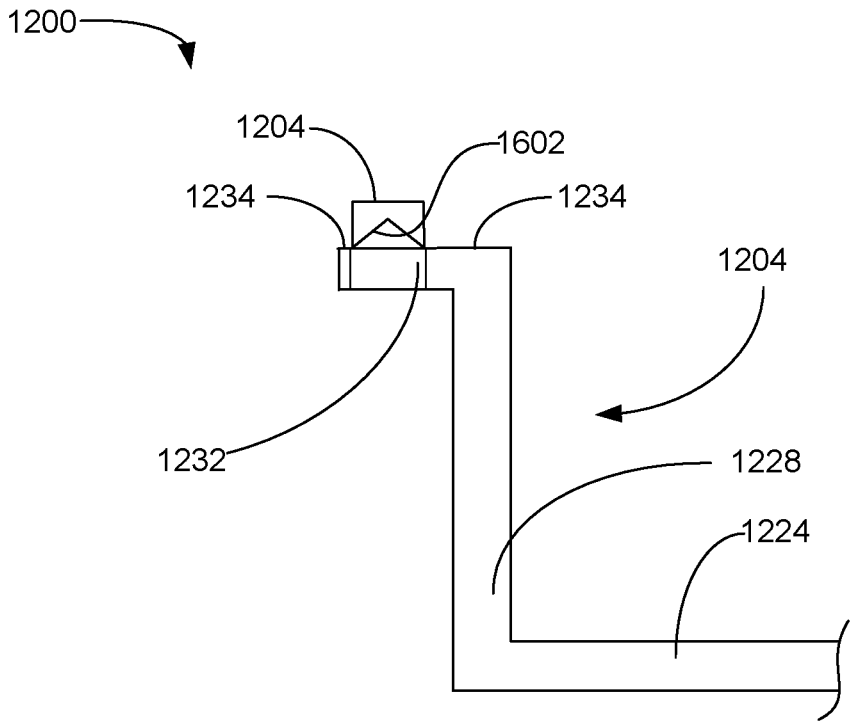
FIG. 16 is a cross sectional view through a cross section similar to cross section AA illustrating a detail of the second exemplary embodiment of the torsion spring ceiling grill of FIG. 12, according to a preferred embodiment of the present invention.

FIG. 16 is a cross sectional view through a cross section similar to cross section AA illustrating a detail of the second exemplary embodiment of the torsion spring ceiling grill 1200 of FIG. 12, according to a preferred embodiment of the present invention. Knife blade 1204 is shown with a V-shaped sharp edge 1602 bridging the spring-receiving opening 1232. In various embodiments, various knife configurations may be used, within the constraint that the knife blade 1204 be capable of severing the severable connector 1202. Backing plate 1204 is shown in more detail, with perimeter flange 1224 (similar to backing plate 124) supporting vertical panel 1228, which, in turn, supports top horizontal panel 1234.

Figure 17:
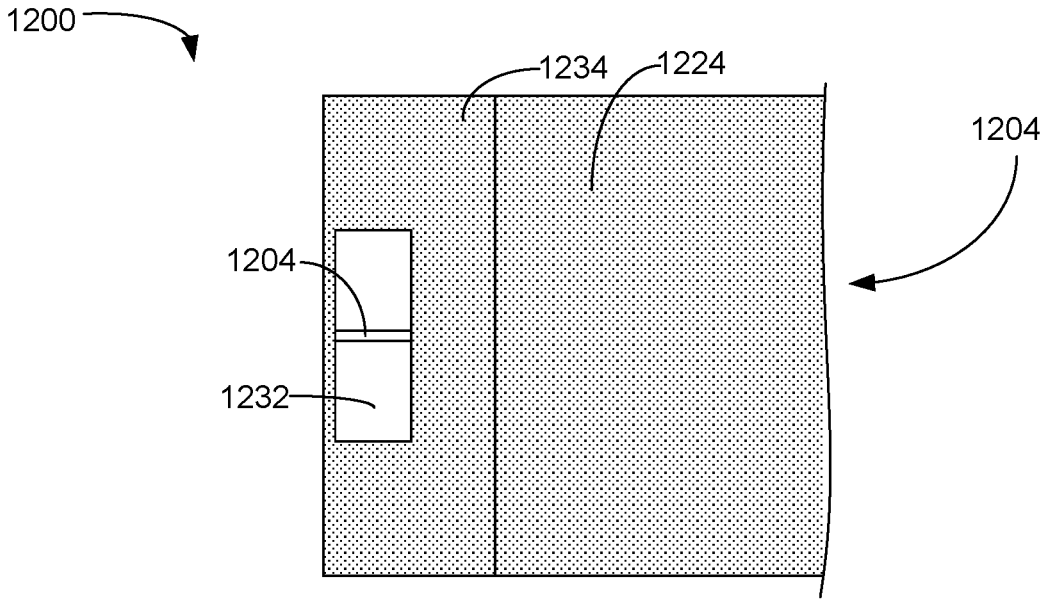
FIG. 17 is a top plan view illustrating a detail of the second exemplary embodiment of the torsion spring ceiling grill of FIG. 12, according to a preferred embodiment of the present invention.

FIG. 17 is a top plan view illustrating a detail of the second exemplary embodiment of the torsion spring ceiling grill 1200 of FIG. 12, according to a preferred embodiment of the present invention. The centered position of knife blade 1204 can be more easily seen.

The advantage of being able to reconfigure for various thickness of ceiling tile includes the cost advantage in manufacturing of being able to manufacture one device for all the various ceiling tile thicknesses, instead of having to manufacture a different device for each of the various thicknesses of ceiling tile. The advantage of being able to install with a single upward motion includes the reduced labor costs at the job site.

I claim:

1. A torsion spring ceiling grill comprising:

a grill plate supporting a plurality of torsion spring assemblies, each of which is operable to be reconfigurable in position at any point along a slot;

a backing plate adapted to receive first and second arms of said torsion spring assemblies;

wherein said backing plate comprises an operationally horizontal backing plate perimeter flange terminating, at least at a plurality of portions of an interior edge of said backing plate perimeter flange, in at least one operationally vertical panel which, in turn, terminates in at least one inwardly extending top horizontal panel;

at least one spring-receiving opening in said at least one top horizontal panel;

a severable connector connecting said first and second arms in a sufficiently proximate configuration to enable insertion into said at least one spring-receiving opening; and a knife blade mounted above said top horizontal panel, centered on said spring-receiving opening, and adapted to sever said severable connector when said first and second arms are inserted into said at least one spring-receiving opening.

2. The torsion spring ceiling grill of claim 1, wherein said grill plate comprises an operationally horizontal grill plate perimeter flange extending from, at least at a plurality of exterior portions of, at least one operationally vertical torsion spring support panel operable to support said torsion spring assemblies.

3. The torsion spring ceiling grill of claim 2, wherein said at least one torsion spring support panel comprises at least one said slot adapted to engage at least one portion of a torsion spring assembly of said plurality of torsion spring assemblies.

4. The torsion spring ceiling grill of claim 3, wherein said at least one slot is vertical.

5. The torsion spring ceiling grill of claim 3, wherein each said torsion spring assembly of said plurality of torsion spring assemblies comprises:

an actuator having radial dimensions larger than a width of said at least one slot;

an axle, having a diameter less than the width of said at least one slot, extending from said actuator;

a coil spring portion of a torsion spring engaged slidingly over said axle;

said first and second arms extending from opposing ends of said coil spring; and a spring retainer releasably coupled to said axle.

6. The torsion spring ceiling grill of claim 3, wherein said axle extends though said slot from an interior side of said vertical spring support panel and receives a nut and a spacer, a coil of said torsion spring, and a spring retainer, in that order.

7. The torsion spring ceiling grill of claim 2 comprising a plurality of discrete vertical torsion spring support panels.

8. The torsion spring ceiling grill of claim 2, comprising a ceiling tile having a ceiling tile opening, wherein said at least one vertical torsion spring support panel comprises an exterior perimeter interior to an interior perimeter of said at least one top horizontal panel.

9. The torsion spring ceiling grill of claim 1, comprising said at least one spring-receiving opening in said at least one top horizontal panel having a rectangular shape.

10. The torsion spring ceiling grill of claim 1, comprising a ceiling tile having a ceiling tile opening, wherein said at least one operationally vertical panel has an interior perimeter coextensive with a perimeter of said ceiling tile opening.

11. The torsion spring ceiling grill of claim 1, wherein said at least one top horizontal panel extends over said ceiling tile opening when said backing plate is installed on a top surface of said ceiling tile.

12. A torsion spring ceiling grill comprising:

a grill plate supporting a plurality of torsion spring assemblies, each of which is operable to be reconfigurable as to position at any point along a slot;

a backing plate adapted to receive first and second arms of said torsion spring assemblies; and wherein said grill plate comprises an operationally horizontal grill plate perimeter flange extending from, at least a plurality of portions of, at least one operationally vertical torsion spring support panel operable to support said torsion spring assemblies;

wherein said backing plate comprises an operationally horizontal backing plate perimeter flange terminating, at least at a plurality of portions of an interior edge of said backing plate perimeter flange, in at least one operationally vertical panel which, in turn, terminates in at least one inwardly extending top horizontal panel;

at least one spring-receiving opening in said at least one top horizontal panel;

a severable connector connecting said first and second arms in a sufficiently proximate configuration to enable insertion into said at least one spring-receiving opening; and a knife blade mounted above said top horizontal panel, centered on said spring-receiving opening, and adapted to sever said severable connector when said first and second arms are inserted into said at least one spring-receiving opening.

13. The torsion spring ceiling grill of claim 12, wherein said torsion spring support panel comprises at least one vertical said slot adapted to engage at least one portion of a torsion spring assembly of said plurality of torsion spring assemblies.

14. The torsion spring ceiling grill of claim 12, comprising a plurality of discrete vertical torsion spring support panels.

15. The torsion spring ceiling grill of claim 12, comprising said at least one spring-receiving opening having a rectangular shape in said at least one top horizontal panel.

16. The torsion spring ceiling grill of claim 12, comprising a ceiling tile having a ceiling tile opening, wherein said at least one vertical torsion spring support panel comprises an exterior perimeter interior to an interior perimeter of said at least one top horizontal panel.

17. A torsion spring ceiling grill comprising:

a grill plate supporting a plurality of torsion spring assemblies, each of which is operable to be reconfigurable as to position at any point along a slot;

wherein said grill plate comprises an operationally horizontal grill plate perimeter flange terminating, at least at a plurality of portions of an interior edge of said grill plate perimeter flange, in an at least one operationally vertical torsion spring support panel operable to support said torsion spring assemblies;

wherein said at least one torsion spring support panel comprises at least one vertical said slot adapted to engage at least one portion of a torsion spring assembly of said plurality of torsion spring assemblies;

a backing plate adapted to receive first and second arms of said torsion spring assemblies;

wherein said backing plate comprises an operationally horizontal backing plate perimeter flange terminating at least at a plurality of portions of an interior edge of said backing plate perimeter flange, in at least one operationally vertical panel which, in turn, terminates in at least one inwardly extending top horizontal panel;

wherein said ceiling tile comprises a ceiling tile opening, wherein said backing plate is attached to a top surface of said ceiling tile and aligned to said ceiling tile opening, wherein said at least one operationally vertical panel has an interior perimeter coextensive with a perimeter of said ceiling tile opening;

further comprising said grill plate aligned to said ceiling tile opening such that first and second arms of each torsion spring assembly extend through respective spring-receiving openings in said at least one inwardly extending top horizontal panel of said backing plate;

a severable connector connecting said first and second arms in a sufficiently proximate configuration to enable insertion into said at least one spring-receiving opening; and a knife blade mounted above said top horizontal panel, centered on said spring-receiving opening, and adapted to sever said severable connector when said first and second arms are inserted into said at least one spring-receiving opening.

18. The torsion spring ceiling grill of claim 17, comprising a plurality of discrete vertical torsion spring support panels.

19. The torsion spring ceiling grill of claim 17, comprising said at least one spring-receiving opening having a rectangular shape in said at least one top horizontal panel.

20. The torsion spring ceiling grill of claim 17 comprising a ceiling tile having a ceiling tile opening, wherein said at least one vertical torsion spring support panel comprises an exterior perimeter interior to an interior perimeter of said at least one top horizontal panel.

* * * * *